US005752755A

United States Patent [19]

Rho et al.

[11] Patent Number: 5,752,755

[45] Date of Patent: May 19, 1998

[54] METHOD FOR MAKING SHADOW MASK FOR COLOR PICTURE TUBE AND A SHADOW MASK MADE THEREBY

[75] Inventors: Hwan-chul Rho; Dong-hee Han; Jae-myung Kim, all of Kyungki-do, Rep. of Korea

[73] Assignee: Samsung Display Devices Co., Ltd., Kyungki-do, Rep. of Korea

[21] Appl. No.: 677,374

[22] Filed: Jul. 5, 1996

[30] Foreign Application Priority Data

Jul. 27, 1995 [KR] Rep. of Korea ..... 95-22525

[51] Int. Cl.[6] ..... H01J 29/07

[52] U.S. Cl. ..... 313/402; 445/47

[58] Field of Search ..... 445/47; 313/402, 313/407, 408

[56] References Cited

U.S. PATENT DOCUMENTS

| | | | |
|---|---|---|---|
| 4,292,565 | 9/1981 | Kanto | 313/407 |
| 5,170,093 | 12/1992 | Yamamoto et al. | 445/47 X |
| 5,433,974 | 7/1995 | Lee | 445/47 X |

*Primary Examiner*—Kenneth J. Ramsey
*Attorney, Agent, or Firm*—Christie, Pakrer & Hale, LLP

[57] ABSTRACT

A shadow mask for color picture tubes made of AK steel has an Ni layer on its surface so that an Fe-Ni alloy layer is obtained in a hydrogen heating furnace to induce substance diffusion of both the Ni layer and the AK steel shadow mask. A method for making shadow mask for color picture tubes including the steps of making a main flat shadow mask body with AK steel, coating its surface with Ni, forming an Fe-Ni alloy layer on the main flat shadow mask, and pressing the main flat shadow mask body to form a certain shape.

3 Claims, 1 Drawing Sheet

METHOD FOR MAKING SHADOW MASK FOR COLOR PICTURE TUBE AND A SHADOW MASK MADE THEREBY

BACKGROUND

The present invention relates to a method for making a shadow mask for color picture tubes that controls color purity degradation and doming phenomena, and the shadow mask made thereby.

In general, color picture tubes using shadow masks include a bulb which constitutes a panel, a funnel, and a neck. A electron gun is disposed on the neck and R,G,B phosphors are spread in the inner surface of the panel. And the shadow mask is spaced in a predetermined distance from the R,G,B phosphors.

Color picture tubes of a shadow mask type have electron beams emitted from an electron gun which pass through apertures of the shadow mask to land on R,G and B pixels, respectively, on a phosphor layer. The shadow mask is combined with a frame so that it constitutes a shadow mask assembly. The shadow mask assembly is disposed on the inside of the panel.

As illustrated in FIG. 3, the shadow mask is made of aluminium killed (AK) steel.

When the electron beams emitted from the electron gun pass through apertures formed in the shadow mask and land on the phosphors, only 15–25% of the beams pass through the apertures. Accordingly, the rest of the electron beams strike the inner surface of the shadow mask to thereby increase the temperature of the shadow mask to about 80° C.–90° C.

As a result, the shadow mask is thermally expanded and domes out, such that the position of the apertures is changed against the electron beams. The above thermal expansion of the shadow mask is particularly found in AK steel shadow masks having a thermal expansion coefficient of about $12–13\times10^{-6}/°C$.

The doming phenomena cause miss-landing of the electron beams on the phosphors, which causes color purity degradation called purity drift.

The above color purity degradation causes more serious problems in large screens, flat screens, and fixed screens. To solve the problems, shadow masks have recently been made of invar alloy (Fe-Ni alloy) having then only 1/10 the thermal expansion coefficient of AK steel shadow masks.

However, not only does invar alloy make etching of apertures and pressing of skirts difficult, the cost thereof is high which increases the manufacturing cost of the device.

SUMMARY

It is an object of the invention to provide a shadow mask for color picture tubes improving color purity while controlling doming phenomena in accordance with thermal expansion.

Another object of the invention is to provide the shadow mask having a low thermal expansion coefficient and low cost for manufacturing.

The above and additional objects are realized in accordance with the present invention which provides a method for making a shadow mask for color picture tubes.

Accordingly, the present invention provides a shadow mask including a main shadow mask body made of AK steel, Ni layer coated on the surface of the main shadow mask body, an Fe-Ni alloy layer which is obtained in a hydrogen heating furnace to induce substance diffusion of both an Ni layer and an AK steel shadow mask.

Also, the invention provides a method of making a shadow mask for color picture tubes including the steps of making a main flat shadow mask body with AK steel, coating its surface with Ni, forming an Fe-Ni alloy layer on the main flat shadow mask when inducing substance diffusion of both an Ni layer and an AK steel shadow mask in a hydrogen heating furnace, and pressing the main flat shadow mask body to form a certain shape.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DESCRIPTION

A preferred embodiment of the present invention will now be described in detail which reference to the accompanying drawings.

Figure 1:
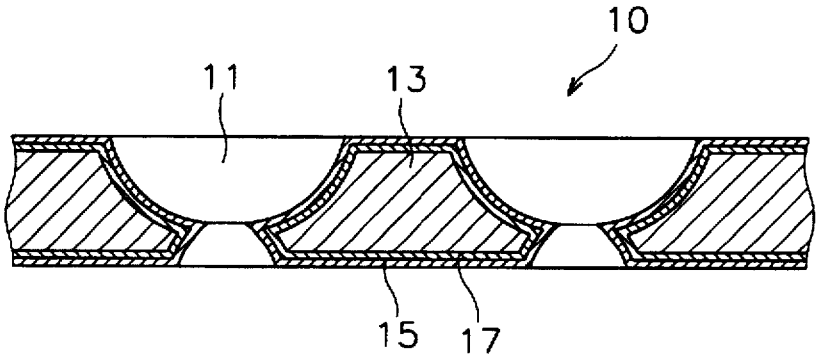
FIG. 1 is a partially cut-away plane view illustrating a shadow mask according to a preferred embodiment of the invention.
Figure 2:
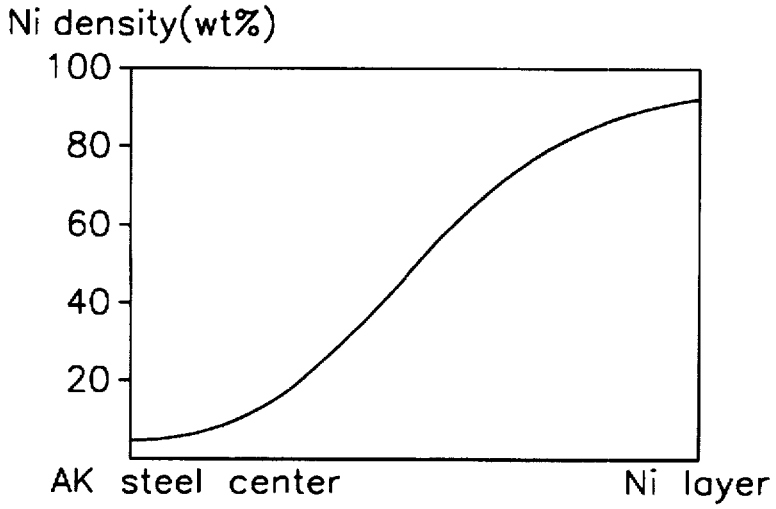
FIG. 2 is a view showing combination ratios of an Fe-Ni alloy layer to an embodiment of the invention.
Figure 3:
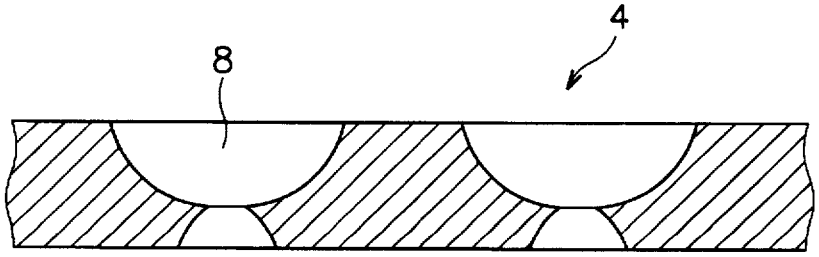
FIG. 3 (Prior Art)
FIG. 3 is a partially cut-away plane view illustrating a prior shadow mask.

Referring first to FIG. 1, there is a cut-away sectional view illustrating a shadow mask in accordance with a preferred embodiment of the invention. The reference numeral 10 refers to the full body of the shadow mask.

As understood in FIG. 1, the shadow mask 10 includes an AK steel shadow mask formed with a plurality of apertures 11 through which electron beams pass.

A bead for supplementing intensity and a skirt portion is formed around the AK steel shadow mask 13.

The AK steel shadow mask 13 is formed with AK steel.

An Ni layer 15 is formed on the outer surface of the AK steel shadow mask 13. An Fe-Ni alloy layer 17 is formed between the Ni layer 15 and the AK steel shadow mask 13.

In this case, the Fe-Ni alloy layer 17 is formed when the shadow mask coated with Ni is annealed in the hydrogen heating furnace to induce the substance diffusion of both the Ni layer and the AK shadow mask.

According to the substance diffusion of both the Ni layer and the AK shadow mask, the Fe-Ni alloy layer 17 has more Ni content in Ni layer than in the AK shadow mask.

According to measurement by the applicant, the Fe-Ni alloy layer 17 has a thermal expansion coefficient of about $4–5\times10^{-6}/°C$. This shows that the Fe-Ni layer has a lower thermal expansion amount than the prior AK steel.

In this case, the Fe-Ni layer 17 forms low thermal expansion film on the outer surface AK steel shadow mask 13 so as to prevent thermal expansion of the AK steel.

According to a number of experiments of the applicant, the shadow mask 10 formed with the Fe-Ni alloy layer 17 has a lower thermal expansion amount of about 40% than the prior shadow mask formed with AK steel.

The above anti-doming effect can improve color purity of color picture tubes, because it prevents miss-landing of the electron beams on the phosphors.

Referring now the method for making such an Fe-Ni alloy layer 17, as the first step, the main flat shadow mask body having a plurality of apertures is made of AK steel.

Thereafter, as the second step, the main flat shadow mask body is coated with Ni. Considering the Fe-Ni layer which must be formed, the Ni coating is formed to be more than 10 μm in its thickness. And the above Ni coating is formed by electroplating or electroless plating.

As the third step, the Fe-Ni alloy layer 17 is formed on the main flat shadow mask when inducing substance diffusion of both the Ni layer and AK steel shadow mask in a hydrogen heating furnace. At this time, the temperature of the hydrogen heating furnace is set at about 1000° C.

Thereafter, as the fourth step, the main flat shadow mask body is pressed so as to form a skirt portion and a bead portion of the shadow mask.

As described above, the shadow mask for color picture tubes can prevent the doming phenomena and improve color purity of the screen.

The Fe-Ni alloy layer and the Ni layer according to the invention can produce structural stability and avoid the howling phenomena.

In addition, the Fe-Ni alloy layer can be used as a substitute for invar alloy which is costly because it is similar to invar alloy in its composition and thermal expansion coefficient.

While this invention has been described in connection with what is presently considered to be the most practical and preferred embodiments, it is to be understood that the invention is not to be limited to the disclosed embodiment, but, on the contrary, it is intended to cover various modifications and equivalent arrangements included within the spirit and scope of the appended claims.

What is claimed is:

1. An aluminum killed (AK) steel shadow mask for color picture tubes comprising:

an AK steel shadow mask;

a Ni layer coated on a surface of the shadow mask, said Ni layer coating having a thickness greater than 10 μm; and an Fe-Ni alloy layer formed in a hydrogen heating furnace to induce substance diffusion of both the Ni layer and the AK steel shadow mask.

2. A method of making a shadow mask for color picture tubes comprising the steps of: making a substantially flat shadow mask from AK steel, coating a surface of the shadow mask with Ni, forming an Fe-Ni alloy layer on the shadow mask by inducing substance diffusion of both the Ni layer and the AK steel shadow mask in a hydrogen heating furnace, and pressing the shadow mask to form a shape.

3. A method of making a shadow mask for color picture tubes according to claim 2 wherein the thickness of the Ni layer is more than 10 μm.

* * * * *